United States Patent [19]

Ludvigsen

[11] Patent Number: 4,710,084

[45] Date of Patent: Dec. 1, 1987

[54] APPARATUS FOR THE APPLICATION OF A STRIP ALONG THE SIDE EDGES OF A SHEET

[75] Inventor: Poul F. B. Ludvigsen, Tommerup, Denmark

[73] Assignee: Brdr. Ludvigsen, Tommfrup APS, Tommerup, Denmark

[21] Appl. No.: 902,448

[22] PCT Filed: Dec. 20, 1985

[86] PCT No.: PCT/DK85/00126

§ 371 Date: Aug. 22, 1986

§ 102(e) Date: Aug. 22, 1986

[87] PCT Pub. No.: WO86/04026

PCT Pub. Date: Jul. 17, 1986

[30] Foreign Application Priority Data

Jan. 7, 1985 [DK] Denmark ..... 75/85

[51] Int. Cl.[4] ..... B42B 9/00

[52] U.S. Cl. ..... 412/9; 282/29 R; 282/29 B

[58] Field of Search ..... 281/15 R; 282/29 R, 282/29 B; 283/81; 412/3, 6, 9

[56] References Cited

U.S. PATENT DOCUMENTS

| | | | |
|---|---|---|---|
| 3,752,504 | 8/1973 | Dixon | 282/29 B |
| 4,369,582 | 1/1983 | Pfeffer | 283/81 X |
| 4,580,815 | 4/1986 | Barber | 283/81 |

FOREIGN PATENT DOCUMENTS

| | | |
|---|---|---|
| 0065776 | 12/1984 | European Pat. Off. . |
| 900330 | 12/1953 | Fed. Rep. of Germany . |
| 1125886 | 3/1962 | Fed. Rep. of Germany . |
| 2318100 | 10/1974 | Fed. Rep. of Germany . |
| 2344716 | 3/1975 | Fed. Rep. of Germany . |
| 10518 | 4/1899 | Sweden . |
| 27388 | 10/1908 | Sweden . |

*Primary Examiner*—Paul A. Bell

*Attorney, Agent, or Firm*—Darby & Darby

[57] ABSTRACT

A quick and safe manner of making a sheet (15) suitable for filing, for example in a loose-leaf binder, is to provide it with a strip (11) along the one side edge of the sheet, said strip being provided with holes (14) for the rings in the file. In order to make the application of such strips (11) simple and precise, according to the invention there is used an apparatus comprising pins (5) upon which the strips (11) can be pushed down. Furthermore, on the sides of the apparatus there are guides (9) which can be displaced in the transverse direction of the apparatus and set in accordance with the size of the sheet, so that the sheet is placed precisely over the adhesive area (12) on the strip. In this position, after a cover foil has been removed from the adhesive (12), the sheet can be pressed down for sticking, after which the sheet with the strip applied can be removed from the apparatus and used for filing.

1 Claim, 3 Drawing Figures

APPARATUS FOR THE APPLICATION OF A STRIP ALONG THE SIDE EDGES OF A SHEET

Figure 1:
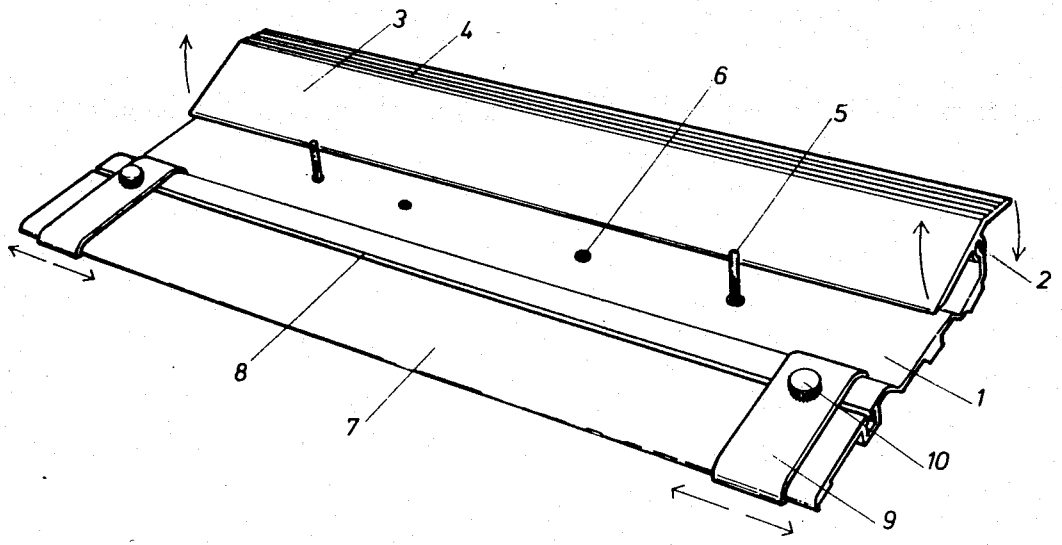

The invention relates to an apparatus for the application of a strip along a side edge on a sheet-formed piece of material, said strip being provided with an adhesive area and preferably with holes for use in the filing of the sheet.

When a sheet is to be filed in a loose-leaf binder or the like, this is normally effected by perforating or by insertion in a pocket which is provided with holes in the side.

The perforation is carried out in the margin of the sheet itself by means of a punching machine arranged for this purpose, and since the material has a low tearing strength, the hole is easily torn open. The filing is thus unsafe and dangerous for the reliability of the file. Moreover, frequent removals and insertions will easily weaken the perforation, and thus this form of filing must be said to be of relatively poor value.

For the improvement of this form of filing, reinforcing rings are known which can be stuck around the holes and which strengthen the edge zone of the holes. The disadvantage here is the difficulty in mounting these rings.

A further drawback with the perforating of sheets is that one thereby perforates the sheet's margin, thus correspondingly limiting the effective area.

Filing by inserting the sheet in a pocket with finished holes is suitable in cases where a single and relatively stiff sheet is involved, since these allow easy insertion. The disadvantage is the inconvenience in placing the sheet in the pocket and in removing it for use. With thin sheets this can, in fact, be very difficult, and it is particularly easy for the tearing off of larger or smaller parts to occur during the removal from the pocket. In addition to this there is the price of the pocket and the space which the pocket takes up in the file. Finally, there is the disadvantage of static electricity, which especially in dry surroundings can easily result in inconvenience to the operating personnel.

The object of the invention is to remedy these drawbacks and disadvantages of the said known filing procedures, and this is achieved with an apparatus which is comprised partly of a bottom which, at its one side, is provided with a hinge to which a clamping plate is secured, partly by one or more upwardly extending pins on which one or more strips with a hole for each pin are placed, in that the clamping plate can rest on the non-adhesive part of the strip, and partly of a support part for the sheet, which resting hereon can lie up against the pins.

By means of this apparatus, a strip can be applied along one or more side edges of a sheet in a simple and easy manner, and it becomes possible to mount such filing strips so quickly and precisely that the filing becomes completely uniform and thereby safe. Since use can be made of a plastic strip which is both light and strong, i.e. tear-proof and flexible, a hitherto unknown possibility is achieved for efficient filing of sheets with plastic strips in, for example, a loose-leaf binder, and notably a particularly hard-wearing form of perforation. By a suitable choice of the colour of the strip, one can also index the sheets to suit requirements. If one wishes to remove the strip, this can easily be cut off, thus leaving a reinforcing strip on the sheet, which can be expedient when the sheet is subject to frequent use.

By providing the apparatus with adjustable guides for the sheet, as presented in claim 2, the apparatus can be used for different sheet widths.

Finally, as presented in claim 3, it is expedient to provide the apparatus with the possibility of adjustment of the guide pins in accordance with the size of the sheet.

Figure 2:
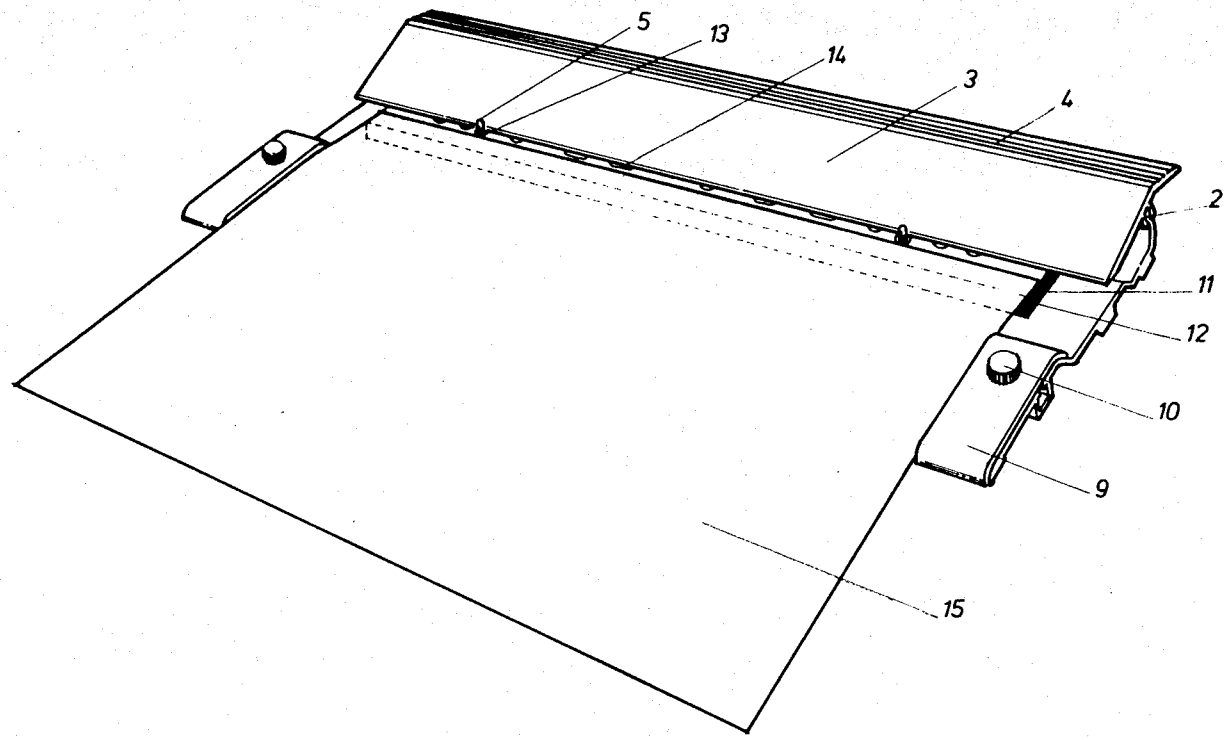
Figure 3:
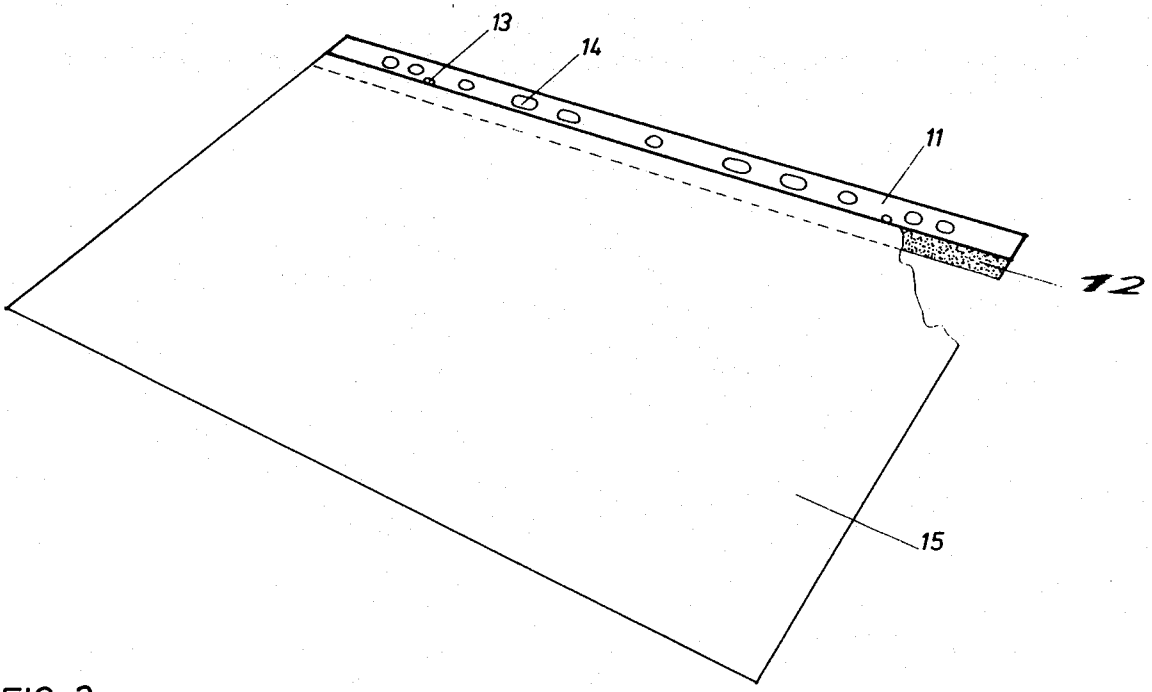

The invention will now be described in closer detail with reference to the drawing, where FIG. 1 shows the empty apparatus seen in perspective FIG. 2 shows the apparatus with strips inserted and a sheet during the application of a strip, and FIG. 3 shows a sheet partly in section with a strip applied.

In FIG. 1 is shown an example of a preferred embodiment of an apparatus according to the invention for use in the application of a strip on a sheet.

The apparatus comprises a bottom 1, the middle of which is sunk in relation to a rear-lying hinge part 2 and a front-lying, downwardly inclined table 7.

On the hinge part 2 is mounted a plate 3 which frontwise extends into the depression in the bottom, and rearwise out over the edge of the bottom with a fluted back edge 4. The hinge 2 allows the plate 3 to seesaw around the rear edge of the bottom when the back edge 4 is pressed down for the lifting of the plate. Lowering of the plate is caused by its own weight.

The parts are preferably made of extruded aluminium, but any other materials can naturally be used as required.

In the middle of the bottom 1 there are provided a number of threaded holes 6 in which upwardly extending pins 5 can be screwed. As can be seen, there is the possibility of changing the position of the pins in the apparatus, depending on the size of the sheet and the strips.

On the front-lying table 7 there is arranged a dovetailed slot 8 in which a bolt 10 can be slid along, in that a nut (not shown) is provided in the slot 8. The bolt 10 is inserted through a plate 9 which functions as side-guide for the sheet to which a strip is to be applied. By loosening the bolt 10, the side-guide 9 can be displaced in the slot 8, and by screwing down, the side-guide 9 can be clamped up against the table 7.

In FIG. 2 is shown a sheet 15 which is in the process of being provided with a strip 11. The strip 11 can be seen more clearly in FIG. 3, which shows a sheet after application of the strip. As will appear from FIG. 3, the strip is provided with an adhesive area 12 at the strip's front edge, holes 13 in the centre for the pins 5, and finally holes 14 for the rings in the loose-leaf binder.

In order to be able to place a number of strips 11 in the apparatus without the strips mutually sticking together, a removable protection film (not shown) is provided over the adhesive area 12 of the strips.

When the strips 11 are placed in the apparatus, the plate 3 is tipped over backwards and the strips are placed on the pins 5, as shown in FIG. 2. The plate is then tipped down, thus holding down the strips while the cover foil is removed from the upper strip 11.

A sheet 15 is hereafter fed in over the adhesive area by letting the end of the sheet lie up against the pins 5, and in this position letting the paper slide down to stick against the adhesive field 12 on the strip 11.

The side-guides 9 are adjusted in accordance with the width of the sheet, and the pins 5 are placed in that position which ensures that sheet and strip are oriented correctly during application in the apparatus.

After application of the strip, the sheet 15 can be removed by lifting it up, and the sheet with strip is now ready for filing.

Hereafter, the procedure can be repeated as required.

In the shown and described example, only strips with holes have been discussed, but it lies within the scope of the invention to apply strips with other forms of punching, including registration tabs, marking fields and the like. Furthermore, in the event of reinforcement being needed on more than one side of a sheet, one is able in a corresponding manner to apply strips along the remaining edges of the sheet.

I claim:

1. An apparatus for application of a strip along a side edge of a piece of sheet-formed material, the strip having adhesive and non-adhesive areas and at least one opening used in filing of the sheet-formed material, said apparatus comprising:

a bottom portion having at least one hole, one end of said bottom portion having a hinge, a clamping plate secured to said hinge, at least one pin protruding substantially upwardly from the hole of the bottom portion, a support part connected to said bottom portion, said support part having side-guides secured thereto for guiding the piece of sheet-formed material, said guides being movable transversely in the direction of insertion of the piece of sheet-formed material, and wherein there are several holes provided within said bottom portion for securing of said pin.

* * * * *